US010865625B2

(12) United States Patent
Delange et al.

(10) Patent No.: US 10,865,625 B2
(45) Date of Patent: Dec. 15, 2020

(54) EXPANDABLE LINER

(71) Applicant: Weatherford Technology Holdings, LLC, Houston, TX (US)

(72) Inventors: Richard W. Delange, Kingwood, TX (US); John Richard Setterberg, Jr., Huntsville, TX (US); Scott H. Osburn, Conroe, TX (US); Michael B. Capehart, Spring, TX (US); Feng Gao, The Woodlands, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 126 days.

(21) Appl. No.: 15/743,929

(22) PCT Filed: Jul. 13, 2016

(86) PCT No.: PCT/US2016/042113

§ 371 (c)(1),
(2) Date: Jan. 11, 2018

(87) PCT Pub. No.: WO2017/011567

PCT Pub. Date: Jan. 19, 2017

(65) Prior Publication Data

US 2018/0371882 A1 Dec. 27, 2018

Related U.S. Application Data

(60) Provisional application No. 62/191,947, filed on Jul. 13, 2015.

(51) Int. Cl.

| | |
|---|---|
| ***E21B 43/10*** | (2006.01) |
| ***E21B 33/10*** | (2006.01) |
| ***E21B 29/10*** | (2006.01) |

(52) U.S. Cl.
CPC ..... *E21B 43/108* (2013.01); *E21B 29/10* (2013.01); *E21B 33/10* (2013.01); *E21B 43/106* (2013.01)

(58) Field of Classification Search
CPC ..... E21B 43/108; E21B 43/106
See application file for complete search history.

(56) References Cited

U.S. PATENT DOCUMENTS

| | | | | |
|---|---|---|---|---|
| 3,477,506 | A | 11/1969 | Malone | |
| 2003/0024711 | A1* | 2/2003 | Simpson | B21D 26/033 166/384 |

(Continued)

FOREIGN PATENT DOCUMENTS

| | | | |
|---|---|---|---|
| WO | 20140063950 | A1 | 5/2014 |

OTHER PUBLICATIONS

Collins Dictionary definition of "coating" accessed May 13, 2020 via https://www.collinsdictionary.com/.*

(Continued)

*Primary Examiner* — Blake E Michener
(74) *Attorney, Agent, or Firm* — Patterson + Sheridan, LLP

(57) ABSTRACT

In one embodiment, a method of completing a wellbore (10) includes positioning an expandable tubular having a support layer (121) disposed on an exterior of the expandable tubular inside a casing (15); mechanically expanding the tubular and the support layer, wherein a distance between an outer diameter of the support layer and the inner diameter of the casing is sufficient to prevent burst of the tubular; and hydraulically expanding the support layer into contact with the casing.

18 Claims, 6 Drawing Sheets

(56) References Cited

U.S. PATENT DOCUMENTS

| | | | | |
|---|---|---|---|---|
| 2003/0051885 | A1* | 3/2003 | Simpson | E21B 43/105 166/384 |
| 2004/0251035 | A1* | 12/2004 | Simpson | E21B 43/105 166/384 |
| 2005/0126251 | A1* | 6/2005 | Oosterling | E21B 43/103 72/393 |
| 2006/0191691 | A1* | 8/2006 | Lohbeck | E21B 43/105 166/382 |
| 2007/0221374 | A1* | 9/2007 | Filippov | E21B 43/103 166/207 |
| 2008/0309069 | A1 | 12/2008 | Breziat | |
| 2013/0032411 | A1* | 2/2013 | John | C09D 127/18 175/320 |
| 2014/0027118 | A1 | 1/2014 | Delange | |

OTHER PUBLICATIONS

EPO Extended European Search Report dated May 14, 2019, for European Patent Application No. 19166958.9.
International Search Report and Written Opinion, PCT/US2016/042113, dated Jan. 19, 2017.
Australian Office Action dated Jun. 15, 2020, for Australian Patent Application No. 2016294427.

* cited by examiner

TABLE 1

Tension Build Up Analyses

Three Frac Internal Pressure Cases 1 8,700 psi
2 12,500 psi
3 15,000 psi

Tension Load Build Up Table

| Pi | Trapped Expansion Force | Thermal Expansion | Internal Pressure (Ballooning) | End Thrust | Total With End Thrust | Total Without End Thrust |
|---|---|---|---|---|---|---|
| psi | lbs | lbs | lbs | lbs | lbs | lbs |
| 8,700 | 61,000 | 115,000 | 59,000 | 80,000 | 314,000 | 234,000 |
| 12,500 | 61,000 | 115,000 | 84,000 | 115,000 | 375,000 | 260,000 |
| 15,000 | 61,000 | 115,000 | 101,000 | 138,000 | 415,000 | 277,000 |

TABLE 2

FIG. 4

Connection & Pipe Overview

| Case | Typical Threaded Connection | Pipe Body |
|---|---|---|
| Ambient | lbs | lbs |
| Min. Yield (80ksi) | 98,000 | 214,000 |
| Est. Actual Yield* | 109,000 | 235,000 |
| Min. Ultimate | 117,000 | 254,000 |
| Est. Actual Ultimate | 129,000 | 279,000 |
| Est. Actual Ultimate at 300° F | 117,000 | 253,000 |
| Total Tension at 8700 psi without / with End Thrust | 234,000 / 314,000 | 234,000 / 314,000 |

* (Actual yield strength is typically 8-10% higher than minimum yield strength)

TABLE 3

FIG. 5

| Example of a single expansion liner with thick coating to reach full support | | |
|---|---|---|
| Outer Casing Description | Liner Description | Expansion |
| 5 1/2 in. 20 lb/ft 0.361 in. wall | 4 in. 0.250 in. wall | Coating compression |
| Maximum ID = 4.868 in. | Coating Thickness = 0.150 in. | 0.040 in. at max. ID<br>27% compression |
| Nominal ID = 4.778 in. | Coated Liner OD = 4.300 in. | |
| Minimum ID = 4.695 in. | | 0.127 in. at min. ID<br>85% compression |
| | | Expanded Liner OD<br>4 + 0.648 in.<br>4.648 in. (11.2% expansion) |
| | 4 1/4 drift inside 20# = 4.079 in.<br>(0.069 in. difference) | Drift = 4.109 in.<br>(0.069 in. difference) |

TABLE 4

FIG. 6

EXPANDABLE LINER

BACKGROUND OF THE INVENTION

Field of the Invention

Embodiments of the present invention generally relate to an expandable liner. In particular, embodiments of the present invention relate to an expandable liner for a high pressure operation and methods of installing the liner.

Description of the Related Art

As shale formation development has evolved, the completion technique has typically been to hydraulic fracture the production formation using fluids with proppants at treating pressures between 10,000 psi and 15,000 psi. To achieve a successful fracturing treatment, only small sections of formation are fractured at a time to maximize the amount of fluid and proppant that is deposited. It is not uncommon for one well to have 10 or more fracturing stages. These multiple treatments can be achieved when the well is initially completed because there are no production perforations in the casing. The fracturing operation starts at the bottom of the wellbore by perforating and fracturing the first zone. After treating the first zone, a plug is set above those perforations, and the second zone is perforated and fractured. The process is repeated until all zones are treated.

As the well ages, it is likely to need secondary hydraulic fracturing treatments. The old perforations are first sealed and then a multi-stage fracturing operation is performed again.

Expandable liners may be used to seal the old perforations. However, use of typical expandable liners has some drawbacks. For example, expanded liners typically have an internal pressure rating of around 5,000 psi. Because the expansion process requires developing significant force to move a mechanical expansion cone through the liners and connections, the liners used for expandable systems are generally thinner in wall thickness for a specific outside diameter than standard casings installed downhole. The strength of the liners is also weaker than standard casing. These two factors combine to keep the liner's strength and pressure resistance before and after expansion very low compared to standard liners or casings.

Another drawback is the liner cannot be expanded to reach the inner diameter of outer casing in all instances, even in a single wellbore. Cones used to expand the liner may be a solid steel tool. Also, the outer casing may have a wide range of possible inside diameters ("I.D.") due to manufacturing tolerances, corrosion, and erosion. Because the expansion force required to move the cone is critical and because carbide anchors and rubber seal elements are on the outside of the liner, the outside surface of the expanded liner cannot be expanded sufficiently to reach the casing I.D. Furthermore, solid expansion cones cannot vary the amount of liner expansion in response to the shape and size of the casing ID.

In addition, in a fracturing application where the fracturing pressure is high, seals are needed between the expanded liner and casing annulus to prevent the fracturing fluids from migrating up and down. Expensive rubber seals squeezed between the liner and the casing have been the only possible way to prevent this fluid migration and, because they protrude above the pre-expanded liner OD, they can cause some resistance to deployment of the liner going into the well. Most shale wells are completed with very long horizontal sections that can reach 6,000 to 10,000 feet in measured length. The wells start out as a vertical hole, then start turning towards horizontal by creating a deviated hole on a circular radius and then again drilling straight in the horizontal direction. Any resistance to deployment would not be desirable.

Another issue with these re-fracturing applications is that the expanded liner must maintain its position once installed with respect to the casing. The reason for this is that the perforations are small holes, commonly about 0.375 in. in diameter, and the perforations extend through the expanded liner, the casing, and cement behind the casing. If the liner longitudinally shifts position after the perforations are made, the holes in the liner would become misaligned with the holes in the casing. In addition, the holes may become misaligned due to difference in temperature. For example, the wellbore temperature can be about 250° F. while the fracturing fluid is surface temperature, typically ranging from 80-40° F. The cool fracturing fluid will cool the expanded liner temperature, which tends to cause the expanded liner to shrink in length. If the liner is not completely fastened or fixed in position, the liner will shrink in length, while the casing, which is cemented, cannot shrink.

Typical liner repair applications using expandable pipe and connections can often have similar drawbacks of pressure resistance. High pressure water or gas leaks in existing casing can be repaired with expandable liners but often the external pressure applied to the installed liner would be beyond the liner's collapse pressure resistance. The opposite can also be true. The expanded liner may not have the internal pressure resistance to handle the applied production pressure. Using higher strength liner pipe can help but there is a limit to the wall thickness and yield strength due to the expansion force required to expand thicker and stronger pipe.

If the current types of expandable liners are used, they are subject to liner body rupture under these very high production pressures because the liner will start expanding again under the applied internal pressure. Due to the size of the annular space between the expanded liner and the casing ID, the liner will rupture or burst in response to further expansion caused by the applied internal pressure. For example, an expanded 4¼" liner will normally be about 0.125 to 0.200 inches on diameter from the outer casing ID. The liner will rupture before reaching the outer casing ID if the annular space is more than about 0.080 inches on diameter, or 0.040 inches to the side if the liner is concentric relative to the outer casing. It must be noted that in a horizontal or mostly horizontal section, the unexpanded liner may be lying on the bottom of the outer casing inside diameter, thereby leaving all 0.080 inches of space on one side.

There is, therefore, a need for an expandable liner for completing or repairing a wellbore capable of withstanding high pressure. There is also a need for a method of installing an expandable liner to withstand high pressures.

SUMMARY OF THE INVENTION

In one embodiment, a method of completing a wellbore includes positioning an expandable liner having a support layer disposed on an exterior of the expandable liner inside a casing; mechanically expanding the liner and the support layer, wherein a distance between an outer diameter of the support layer and the inner diameter of the casing is sufficient to prevent burst of the liner; and hydraulically expanding the support layer into contact with the casing.

In another embodiment, a method of completing a wellbore includes positioning an expandable liner having a support layer disposed on an exterior of the expandable liner inside a casing; mechanically expanding the liner and the support layer, wherein the support layer is expanded into contact with an inner diameter of the casing, and the support layer is compressed.

In another embodiment, an expandable liner includes an expandable tubular having a threaded connection; and an elastomer comprising polyurea disposed around an exterior of the expandable tubular.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 4 shows Table 2, which illustrates the tension build up on the liner connection at three different internal pressures.

FIG. 5 shows Table 3, which compares a typical threaded connection on the softer grade of liner material to a tri-layer configuration described herein.

FIG. 6 shows Table 4, which shows an example of a single cone expansion of a liner, that resulted in a compliant expansion of the support layer against the outer casing ID.

DETAILED DESCRIPTION

In one embodiment, an expandable liner is equipped with a support layer disposed around the exterior of the expandable liner. Initially, the expandable liner is expanded using an expansion tool. After the initial expansion, a support annulus is formed between the outer diameter of the support layer and the inner diameter of the outer casing. The support annulus is of sufficient size wherein further hydraulic expansion of the expandable liner will not cause the expandable liner to burst.

Figure 1:
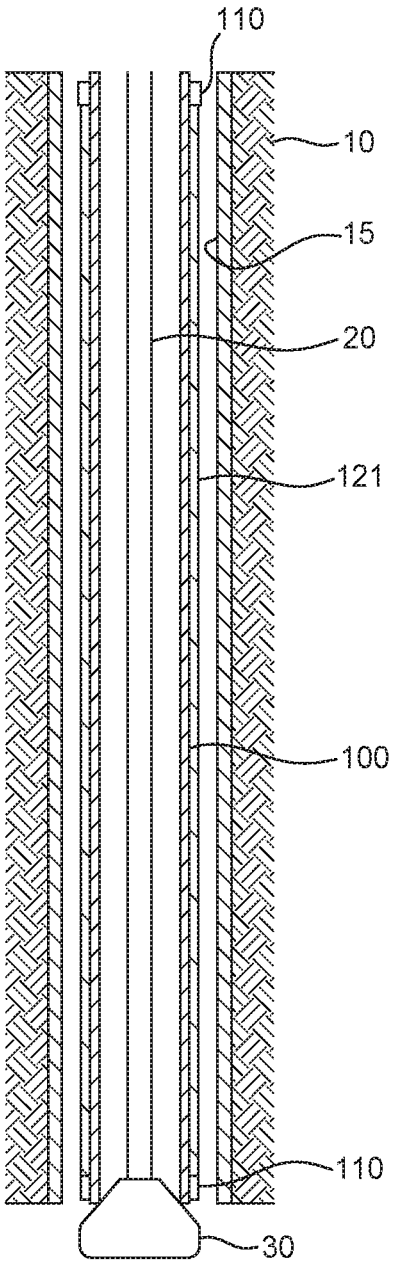
FIG. 1 shows an exemplary embodiment of an expandable liner.
Figure 2:
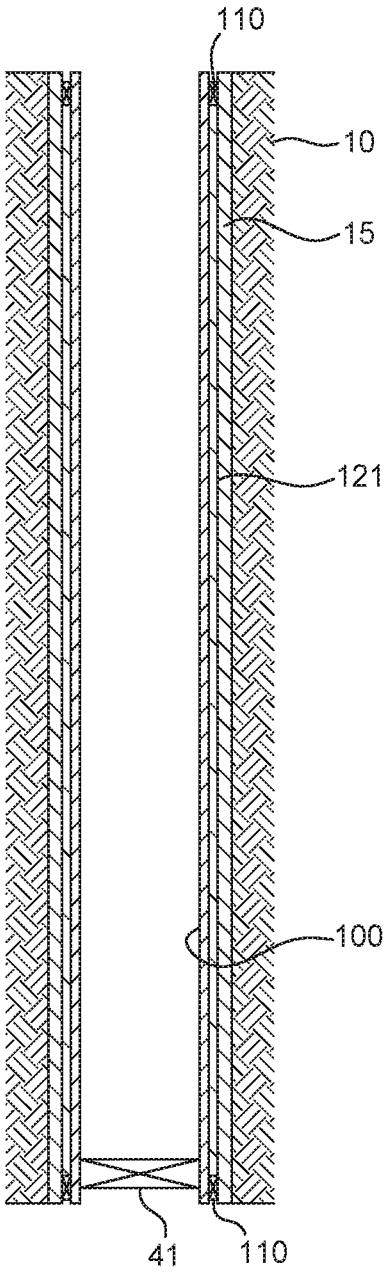
FIG. 2 shows expandable liner of FIG. 1 after expansion.
Figure 3:
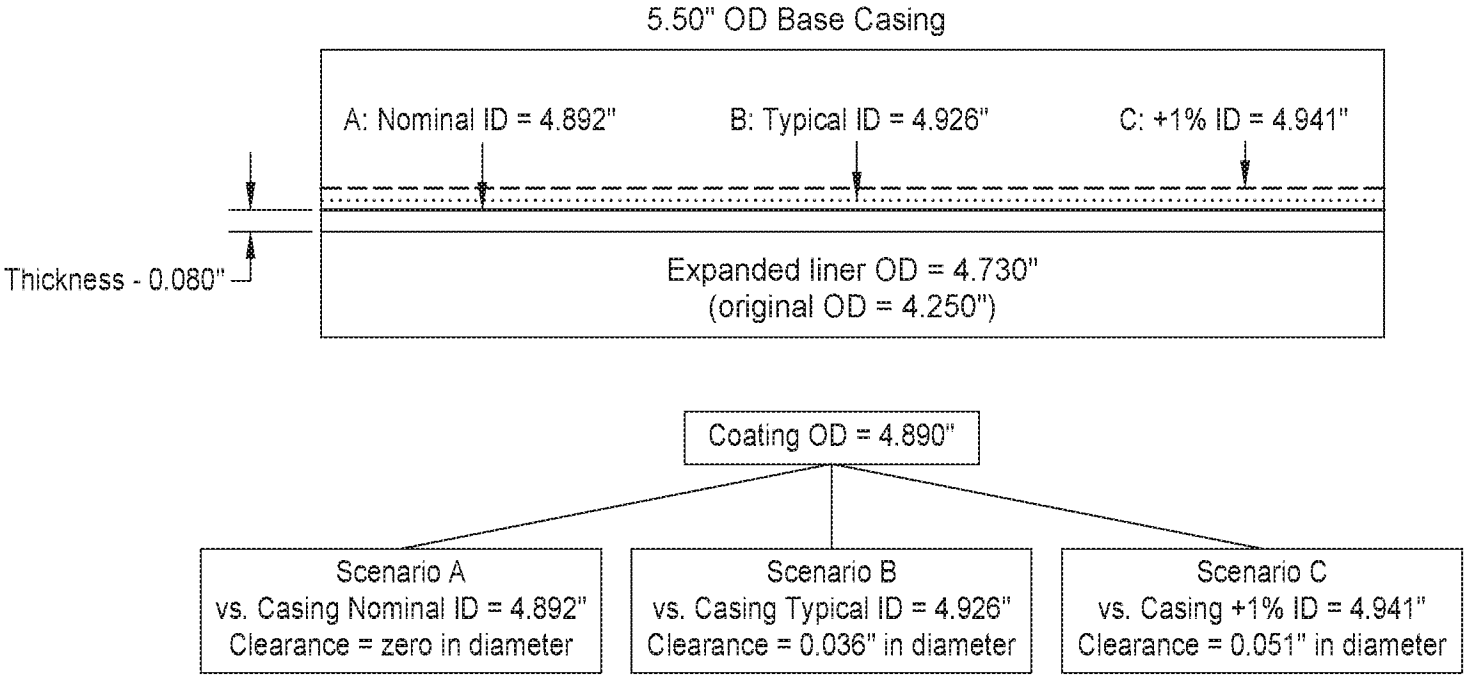
FIG. 3 shows Table 1, which shows the clearance between the liner and three different potential inner diameters of the casing after mechanical expansion.

FIG. 1 shows an exemplary embodiment of an expandable liner 100 positioned in a pre-existing wellbore 10. The wellbore 10 may include a casing 15 is conveyed into the wellbore 10 using a conveying string 20, which may be made up using drill pipe. The conveying string 20 includes an expansion tool 30 at its lower end. The expansion tool 30 is configured to support the liner 100 during run-in. In one embodiment, the lower portion of the liner 100 is partially expanded and rests on the upper surface of the expansion tool 30. An optional anchor 110 may be provided at a lower portion of the liner 100. In one embodiment, the anchor 110 may be formed by including carbide, elastomer, or both on the liner's outer surface for engagement with the inner surface of the casing 15 upon expansion of the liner 100.

In one embodiment, the liner 100 includes a support layer 121 disposed around the exterior of the liner 100. In one embodiment, the support layer 121 may be an elastomeric layer. The support layer 121 may be disposed on the liner 100 using any suitable method. For example, the support layer 121 may be adhered, coated, or sprayed onto the liner 100. The support layer 121 may have a thickness between 0.02 inches and 0.3 inches; preferably, between 0.05 inches and 0.15 inches. Exemplary thicknesses include 0.06, 0.07, 0.08, 0.09, 0.10, 0.11, 0.12, 0.13, and 0.14 inches. The support layer 121 may be compressible. For example, the support layer 121 may have from 0% to 85% compressibility, from 10% to 80% compressibility, from 50% to 85% compressibility, and from 65% to 80% compressibility. Other suitable compressibility ranges include from 15% to 30% and from 20% to 25%. In one example, the outer casing 15 may be sufficiently strong to resist expansion when the expandable liner 100 and support layer 121 reach the inner diameter of the outer casing 15. In another example, the outer casing 15 may experience some expansion after the liner 100 and support layer 121 reaches the inner diameter of the outer casing 15. A support layer 121 having a higher compressibility will allow the liner 100 and the support layer 121 to reach support against the outer casing 15 in either example. When the support layer 121 has been compressed sufficiently, such as between 10% to 80%, the support layer 121 may become behave similar to a liner 100 or the outer casing 15. The liner 100, support layer 121, and outer casing 15 form a three part assembly of a non-metal layer disposed between two metal tubulars. In the embodiment where polyurea is the support layer 121, the support layer 121 has a yield strength between 1,000 psi to 10,000 psi; preferably between 2,500 psi to 9,000 psi. The support layer 121 may be resistant to at least one of water, hydrocarbons, carbon dioxide, hydrogen sulfide, and combinations thereof. In another embodiment, the support layer 121 is temperature resistant up to at least 300° F., or temperature resistant between 40° F. and 1,000° F. In yet another embodiment, the support layer 121 is sufficiently abrasion resistant to protect the liner 100, including its connections, during run-in. In one example, at least 80% of the thickness of the support layer 121 remains intact after reaching target depth and prior to expansion. In one embodiment, the difference in material between the liner 100 and the support layer 121 may prevent corrosion of the exterior of liner covered by the support layer. In one embodiment, the support layer may have an elongation property of at least 25%; preferably, between 25% and 300%; more preferably, between 50% and 250%, as measured according to ASTM-D 412. In one embodiment, the support layer may have a shore D hardness between 30 and 85; preferably, between 45 and 65, as measured according to ASTM D-2240. In one embodiment, the support layer may have a tensile strength between 1,500 psi and 4,000 psi, between 1,500 psi and 3,000 psi, or between 2,000 psi and 3,700 psi, as measured according to ASTM D-412.

In one embodiment, the support layer 121 may be made from an elastomer such as polyurea or derivatives thereof. Polyurea can be derived from the reaction product of an isocyanate component and a synthetic resin blend component through step-growth polymerization. The isocyanate can be aromatic or aliphatic in nature. It can be monomer, polymer, or any variant reaction of isocyanates, quasi-prepolymer or a prepolymer. The prepolymer, or quasi-prepolymer, can be made of an amine-terminated polymer resin, or a hydroxyl-terminated polymer resin. For example, the isocyanate component may include one or more of the following chemicals: methylene diphenyl diisocyanate (MDI) including isomers such as 4,4' MDI, 2,4' MDI, and 2,2' MDI, isophorone diisocyanate (IPDI), toluene diisocyanate (TDI), hexamethylene diisocyanate (HDI), and methyl isocyanate (MIC). The synthetic resin blend component may include one or more of the following chemicals: diethyltoluene diamine (DETDA), isophorone diamine (IPDA), diethylmethylbenzenediamine, and poly[oxy(methyl-1,2-ethanediyl)]. The percent make up of each chemical in the two components is variable, such as from 3:1 to 1:3 ratio of isocyanate to resin blend. In one example, the two components are mixed in a ratio of 1 part isocyanate to 1 part synthetic resin blend. In another example, the two components are mixed in a ratio of 2 parts isocyanate to 1 part synthetic resin blend. This yields a multitude of coatings with a variety of performance characteristics. These characteristics include the toughness and abrasion resistance to protect the pipe and the connections from damage while going into the wellbore, the compressibility necessary to seal off the annulus between the liner outer diameter and the wellbore inner diameter, and the friction necessary to anchor the liner to the wellbore. Suitable polyureas have been used in floor and wall protection in food processing, food storage, and production area; and as lining for vehicles and storage tanks. Exemplary polyureas suitable for use as the support layer include polyurea coatings commercially available from companies such as Rhino Linings, Line-X corporation, VersaFlex Incorporated, and International Polyurethane Solutions. In another embodiment, the support layer 121 may be made from a rubber such as nitrile butadiene rubber. In another embodiment, the support layer 121 may be made from high density polyethylene or low density polyethylene. In yet another embodiment, the support layer 121 may be made from fiberglass, cork, natural rubber, cement, and combinations thereof. In yet another embodiment, the support layer 121 may be any material suitable for being disposed on a tubular that can act as a filler material between the liner and the casing, remain substantially intact during run in, and form a seal between the liner and the casing upon compression.

In one embodiment, the support layer 121 may be disposed on the entire length of the liner 100. In another embodiment, the support layer may be disposed on between 85% and 99% or at least 75% of the exterior surface the liner 100. In yet another embodiment, the support layer may be intermittently or continuously disposed on at least 15% of the exterior surface of the liner 100. Other suitable support layer coverages of the liner include at least 50%, and between 60% and 99.9%. In one example, the support layer 121 may be disposed as ribs on the liner 100 longitudinally, radially, or in a spiral. In another example, the axial distance separating two adjacent areas covered with the support layer is less than or equal to 2.5 times the outer diameter of the liner, for example, between 0.5 times to 2 times the outer diameter of the liner.

In one embodiment, the support layer 121 is sprayed on the liner 100. In one example, the support layer 121 is applied using a high pressure impingement equipment. The isocyanate component and the resin component can be heated to a temperature between 110-170° F. before being dispensed by the impingeme equipment.

In one embodiment, the support layer 121 may be sufficiently resistant to protect the liner and its connections. For example, the support layer 121 may protect the liner from abrasive rubbing as the liner 100 is installed in the wellbore. For example, the support layer 121 is sufficiently resistant to abrasive rubbing to the extent that the metal of the liner 100 is protected from abrasion or scratching damage due to dragging or impact. As mentioned, a typical wellbore will be straight at first, then start bending toward being totally horizontal for 5,000 feet or more. In one embodiment, the support layer has sufficient strength to protect the metal box sections of the threaded connections used to connect the tubular joints forming the liner. In another embodiment, the liner may be protected using a metal sleeve or other suitable connection protection as is known to one of ordinary skilled in the art.

In another embodiment, the support layer 121 may act as an anchor between the expanded liner and outer casing ID. The support layer may provide resistance to axial movement of the liner inside the casing. A sufficient resistance to axial movement may eliminate the need for crushed carbide or other type anchors. In another embodiment, the support layer may seal pressure or be effective at blocking fracturing fluid migration, thereby eliminating use of traditional rubber seals.

Exemplary expansion tools include a solid cone or an expandable cone. The expansion tool 30 may be mechanically or hydraulically actuated. In one embodiment, the expansion tool 30 may be a hydraulically pumped cone. During operation, the bottom of the liner is sealed so pressure can build up between the cone and the liner bottom. The expansion starts at or near the bottom of the liner and moves up toward the top of the liner. This type of expansion process does not require any anchors unless there is a desire to retain the liner in a certain location in the wellbore. If needed, one or more anchors may be used to anchor the liner. In another embodiment, the expansion tool 30 is a mechanical cone, as shown in FIG. 1. The cone may be pulled using a jack, the rig, or both. This expansion process also starts at or near the bottom and moves toward the top. In one embodiment, at least one anchor is used at the bottom of the liner to hold the liner in place as the cone is pulled up. In another embodiment, the expansion tool such as a cone may be selected to control size the annular space between the outer diameter of the support layer and the inner diameter of the casing 15. For example, the cone may be configured to expand the liner 100 such that the outer diameter of the support layer is sufficiently close to the inner diameter of the outer casing to prevent rupture of the expandable liner 100 when high pressure is applied. Because the rupture initially form as a swollen area in the liner 100, the rupture may be prevented if the distance between the liner 100 and the casing 15 is less than the distance required for the swollen area to reach rupture. In one example, the annular space after expansion is about 0.08 inches on diameter, e.g., 0.04 inches to the side. In another example, the annular space after expansion is between 0.001 inches and 0.05 inches to the side; preferably, between about 0.002 inches and about 0.04 inches to the side; more preferably, between about 0.002 inches and about 0.025 inches to the side; most preferably, between about 0.008 inches and about 0.024 inches to the side. In another embodiment, the support layer may be in contact with the inner diameter of the casing 15 and compressed after expansion by the cone. In this embodiment, the expansion tool such as a cone may be selected to control the desired amount of compression on the support layer. In the example of a horizontal wellbore section, the liner may be lying on the bottom of the outer casing, in which case, the annular space will be eccentric toward one side of the liner.

In one operation, the expandable liner 100 with the support layer 121 may be used in a re-fracturing application of an existing wellbore 10. The support layer 121 is about 0.08 inches thick and is made of a polyurea having a compressibility between 60% and 85%. The wellbore 10 may have a long horizontal completion section having 5.5 inch outer casing 15. Initially, the liner 100 is positioned in the wellbore 10 at the location of interest, as shown in FIG. 1. The conveying string 20 may include an expansion cone 30 for expanding the anchor 110 into engagement with the casing 15. In one example, a 4.25 inch liner is used to re-complete the 5.5 inch cased wellbore. The outer casing may have a nominal inner diameter of about 4.89 inches, although the inner diameter may vary by about one percent. The liner has a wall thickness of 0.25 in. and 50,000 psi minimum yield strength. In another embodiment, the liner may have a wall thickness between 0.2 in. and 0.75 in., and has a minimum yield strength between 20,000 psi and 100,000 psi. The liner may have an elongation property of at least 25%; preferably, between 25% and 300%; more preferably, between 50% and 250%, as measured according to ASTM-D 412. Elongation being the percentage in length a pipe can stretch, either longitudinally or circumferentially, prior to rupture or failure. Exemplary materials for the liner 100 include steel, corrosion resistant alloy, stainless steel, and combinations thereof. The cone 30 may be selected to expand the liner 100 such that the outer diameter of the support layer 121 is sufficiently close to the inner diameter of the outer casing 15 to prevent rupture of the expandable liner 100 when high pressure is applied. For example, after expansion, the annular space between the outer diameter of the support layer 121 and the inner diameter of the casing 15 is less than about 0.08 inches in diameter, i.e., 0.04 inches to the side. In another embodiment, the support layer may be in contact with the inner diameter of the casing 15 after expansion by the cone. After setting the anchor 110, the rig may be used to pull the cone 30 to expand the remaining portions of the liner 100. In another embodiment, the liner may be expanded using the jack alone.

Table 1 shows the clearance between the liner and three different potential inner diameters of the casing after mechanical expansion. The different inner diameters of the casing are denoted as "nominal", "typical", and "+1%". In each of the scenarios, it can be seen that the annular area between the outer diameter of the support layer and the inner diameter of the casing is less than 0.08" in diameter.

The expanded liner 100 is further expanded using a high pressure fluid, for example, fracturing fluid. Exemplary hydraulic pressures include over 6,000 psi, over 8,000 psi, or over 9,000 psi. Other suitable hydraulic pressures may be between 5,000 psi and 25,000 psi, between 7,500 psi and 18,000 psi, and any pressures or pressure ranges in between. The high pressure fluid will expand the liner 100 until the outer diameter of the support layer 121 contacts the inner diameter of the outer casing. In one embodiment, the pressure used to expand the liner 100 is greater than or equal to the pressure needed to start circumferential yield of the liner 100. In another embodiment, the applied pressure induces a stress between the yield strength and the tensile strength of the liner 100. In one example, the liner 100 is expanded by applying a 10,000 psi fluid pressure to the interior of the liner 100. The high pressure fluid may expand the entire length of the liner 100. The ends of the liner 100 may be sealed to prevent the expansion pressure from migrating between the liner 100 and the casing 15. Such migration would eliminate the expansion where interstitial pressure was present. The sealing can be accomplished by incorporating elastomeric seals near or at the ends of the expanded liner 100 and trapping the seals between the liner 100 and inner diameter of the casing 15. The expansion ensures the support layer is expanded into contact with the casing 15.

In another operation, the expandable liner 100 with the support layer 121 may be used in a re-fracturing application of an existing wellbore 10. The support layer 121 is about 0.08 inches thick and is made of a polyurea having a compressibility between 60% and 85%. The wellbore 10 may have a long horizontal completion section having 5.5 inch outer casing 15. Initially, the liner 100 is positioned in the wellbore 10 at the location of interest, as shown in FIG. 1. The conveying string 20 may include an expansion cone 30 for expanding the anchor 110 into engagement with the casing 15. In one example, a 4.25 inch liner is used to re-complete the 5.5 inch cased wellbore. The outer casing may have a nominal inner diameter of about 4.89 inches, although the inner diameter may vary by about one to five percent. The liner has a wall thickness of 0.25 in. and 50,000 psi minimum yield strength. In another embodiment, the liner may have a wall thickness between 0.2 in. and 0.75 in., and has a minimum yield strength between 40,000 psi and 100,000 psi. The cone 30 may be selected to expand the liner 100 such that the outer diameter of the support layer 121 is compressed against the inner diameter of the outer casing 15 to prevent rupture of the expandable liner 100 when high pressure is applied.

An advantage of contacting the casing 15 is the potential for rupture of the expanded liner is mitigated when high internal pressure is applied. Once the expanded liner is "supported," i.e., in contact with the outer casing via the support layer, the internal pressure resistance of the liner becomes the pressure that is needed to yield both the liner and the outer casing. After the expansion, the support layer fills the annular space between the liner and the casing. In this respect, internal pressure resistance of the liner is substantially increased. In one example, after expanding the support layer into contact with the casing, the liner has an internal pressure resistance between 6,000 psi and 25,000 psi; preferably, between 8,500 psi and 18,000 psi. In another example, after expansion, the pressure capacity need to yield the liner and the casing is more than 15,000 psi when the outer casing has a typical wall thickness or weight and grade, e.g., 20 lb/ft weight and P-110 or higher strength grade.

Therefore, the super high pressures generated when re-fracturing a well can be applied to a thin liner that is truly clad against the casing inner diameter using an interface of non-metallic coating.

The liner-support layer-casing (also referred to as "tri-layer") configuration advantageously increases the collapse resistance. In general, a collapse failure of a pipe requires the pipe to become distorted in an oval shape. When the liner is supported against the casing, the distorted shape becomes much more difficult to form, thereby substantially increasing the external pressure resistance. Test lab results indicate the collapse resistance may increase up to 50%. In this re-fracturing example, the liner and casing outer diameter sizes may be between 3.5 inches and 5.5 inches, pre-expansion, although other liner and casing outer diameter sizes, such as between 3 inches and 10 inches, are contemplated. An increase in collapse resistance may be useful to prevent cross sectional buckling of the liner during a re-fracturing operation, where the high pressure fracturing fluid will likely migrate behind the casing and apply external pressure on the outer diameter of the casing, the expanded liner, or both.

The support layer may act as an anchor to resist axial movement. As discussed above, the liner will try to shrink in length when exposed to the cooler fracturing fluids. If the liner moves axially during the fracturing operation, the perforations will become misaligned and the effectiveness of the fracture is diminished. In the event that the support layer does not provide much anchoring in certain sections, e.g., due to corroded or eroded sections in the casing, the adjacent sections would provide the anchoring. In one embodiment, compression of the support layer against the casing mechanically attaches the liner to the casing so the liner cannot move longitudinally. The compression of the support layer provides an anchoring strength to the tri-layer configuration, whereby the loading is shared amongst the liner, support layer, and the casing. Compression of the support layer may generate an anchoring force between 2,500 kips/ft. and 12,000 kips/ft. and between 4,000 kips/ft. and 5,000 kips/ft. In another embodiment, the anchoring capacity of the support layer is between 5 kips/ft. and 50 kips/ft. at 250° F.; preferably, between 20 kips/ft. and 40 kips/ft. at 250° F. The amount of anchoring force may be adjusted by manipulating the thickness of the support layer and the amount of internal pressure applied to expand the liner. For example, an increase in the amount of pressure applied to expand the liner may cause a proportional increase in the amount of anchoring force. In another embodiment, the mechanical force applied to expand the support layer against the casing may cause a proportional increase in the amount of anchoring force. For example, the mechanical force is adjusted using a larger size cone, thereby increasing the anchoring force.

Additionally, the liner, acting as an anchor, may help prevent failure of the liner connections. Table 2 illustrates the tension build up on the liner connection at three different internal pressures.

Table 3 compares a typical threaded connection on the softer grade of liner material to a tri-layer configuration described herein.

It can be seen that the typical threaded connection will not have sufficient tension strength to survive if all of the tension loads are experienced. In contrast, the compressed coating, with its anchoring strength, has the ability to anchor the expanded liner tightly against the casing ID such that the outer casing and expanded liner behave under tension loads as a single casing string with each resisting the applied tension. In this respect, tri-layer configuration will behave as a solid when resisting tension loads as well as resisting high pressures, as discussed above. Additionally, if the cement behind the casing is still in good condition, the expanded liner will benefit even more from that additional strength.

During re-fracturing operations, the fracturing fluid will penetrate any path available, including the annular space between the liner and casing. However, embodiments described herein forms a very small or sealed annular space. In one embodiment, expansion and compression of the support layer against the casing traps and squeezes the support layer between the expanded liner and the outer casing. In this respect, compression of the support layer creates a pressure seal between the liner and the outer casing. In yet another embodiment, the compressed support layer is sufficiently able to resist a flow path from developing between the expanded liner and the casing during the fracturing treatment by the fracturing fluid which may include materials such as proppants. In another embodiment, other mechanisms of blocking fluid migration, such as elastomeric seal bands around the pipe or metal protrusions around the pipe, may be used.

The support layer may be used to protect the female or box connection from scratches or gouges that would weaken the connection's ability to expand without splitting. A longitudinal scratch can create stress in these thin box connection sections which can result in a circumferential tensile failure during expansion.

After expansion, the liner 100 may be perforated in one stage or multiple stages. During the first stage, a plug 41 is set at the bottom of the liner 100 and then the liner 100 is perforated. The liner 100 may be perforated with openings of any suitable shape. For example, the openings may be round or a small slit. An elongated opening such as a slit may facilitate fluid communication from the liner to the casing if the liner length changes during the fracturing operation. After perforation, fracturing fluid is supplied at high pressure and high volume. Because the liner 100 is free at one end, the liner 100 is allowed to shrink or expand in response to temperature changes in the liner 100, the internal pressure increase caused by the fracturing fluid, and the end thrust from the fracturing fluid acting on the plug. As a result, tension load on the liner 100 is not dramatically increased, thereby maintaining the tension load below the liner connection's load ratings during the fracturing process. After completing the fracturing process, a second plug (not shown) may be installed above the first zone, and the process is repeated to fracture another zone. In this manner, the wellbore may be re-completed using the expandable liner 100 and re-fractured using a high pressure, high volume fracturing fluid.

In another embodiment, the optional step of squeezing the old perforations with cement may be performed before running the liner to maximize the sealing off of perforations. In yet another embodiment, the optional step of pumping a certain amount of cement behind the liner so that as the cone expanded the pipe, the liner is cemented in place.

In another embodiment, the expandable liner can be mechanically expanded into contact with the outer casing using an expansion tool. For example, the expansion tool may be a cone capable of compliant expansion. That is, the compliant cone is configured to expand the liner such that the support layer contacts the casing inner diameter even if the inner diameter does not have a consistent diameter or roundness. In one example, the compliant expansion may be accomplished using a cone having high strength and some flexibility to variably expand the liner and the support layer to fit a varying inner diameter of the outer casing. In another example, the compliant expansion may be accomplished using two cones traveling up the liner in tandem. In yet another example, the liner may be expanded using an expansion cone that is assembled downhole. In a further embodiment, the liner may be expanded using an inflatable non-metallic expansion system such as an inflatable packer. Other suitable expansion tools include any expansion system capable of expanding the support layer and liner into contact with the inner diameter of the outer casing. Expansion of the support liner would also compress the support layer, thereby increasing the higher internal pressure capability.

In another embodiment, an expandable liner may have a reduced outer diameter and a thicker support layer. For example, the liner may have a reduced outer diameter relative to a standard size tubular as known in the industry. In one example, the liner has a reduced outer diameter relative to a standard 4.25 inch tubular. The outer diameter of the expandable liner may be reduced between 2% and 15%, between 3% and 10%, and between 4% and 8%. The support layer may have a higher compressibility, such as between 50% and 90%, more preferably, between 60% and 85%. In this example, the liner wall thickness and the post expansion inner diameter may remain the same as compared to a non-reduced outer diameter liner. However, the total expansion and compression of the support layer may be achieved in a single expansion step. Because of the high compressibility of the support layer, the liner and the support layer can be expanded into contact with the casing in a single expansion. In one embodiment, the thicker support layer allows contact with the casing inner diameter, regardless of the variations in that casing, such as diameter, ovality, straightness, roughness and others. If a fixed size cone is used, the expanded liner inner diameter would have a consistent diameter. The support layer would be compressed to different amounts depending on the casing ID characteristics. In another embodiment, if expanded using hydraulic pressure, the liner ID would take on the shape of the casing ID and the support layer would have a substantially consistent amount of compression.

Table 4 shows an example of a single cone expansion of a liner, that resulted in a compliant expansion of the support layer against the outer casing ID. The liner in Table 4 has a reduced outer diameter relative to a standard 4.25 in. liner, which allows the support layer to be thicker while maintaining substantially the same overall outer diameter.

In another embodiment, the liner and support layer combination may be expanded against a casing to patch a casing section. For example, the patch formed may prevent internally applied gas or fluid pressure from leaking outside the casing section. In another example, the patch formed may prevent fluids or gas from leaking into the wellbore via the casing section. In yet another example, the patch formed may function as a tubing anchor, a bridge plug, or a packer in a damaged wellbore.

In another embodiment, the casing can optionally be callipered to determine the average inner diameter of the casing. The measurement can be used to select a cone that will expand the liner sufficiently to prevent the liner from bursting in response to high fluid pressure.

In another embodiment, a coiled tubing may be used as an expandable liner and the support layer disposed therearound. Because the coiled tubing does not have any threaded connections, the coiled tubing eliminates the possibility of a threaded connection failure. Use of the coiled tubing as a liner may also significantly increase the burst pressure of the liner and may allow the deployment of the liner in one run.

In another embodiment, the support layer may include metal particles to enhance toughness, anchoring capacity, resistance to fluid migration, resistance to cutting, and combinations thereof. These metal particles can be balls or chips made of steel, Carbide, or other metals of sufficient strength to provide effective performance.

In another embodiment, the support layer may include non-metallic particles to enhance toughness, anchoring capacity, resistance to fluid migration, resistance to cutting, and combinations thereof. These non-metallic particles can be silicate sand, ceramic chips, or other non-metals of sufficient strength to provide effective performance.

In another embodiment, the support layer may be configured to swell upon exposure to certain chemical environments. For example, the support layer may comprise a swellable material having sufficient compressibility characteristics for use in the tri-layer liner, support layer, and casing configuration.

In another embodiment, the support layer may have varied in thickness along the length of the liner. For example, the support layer may be thicker at the ends of the liner and thinner in the middle of the liner to enhance resistance to fluid migration near the connectors in case the connectors started to leak during the high pressure fracturing operations. In another example, the support layer may also be strategically varied along the length of the liner, or within a single joint of liner pipe, to accommodate features or irregularities in the inner diameter of the outer casing.

In another embodiment, the support layer may be sprayed on and then baked at a temperature higher than ambient to enhance toughness.

In another embodiment, the support layer may be sprayed on or formed on the liner outer diameter and then machined to an exact thickness.

In another embodiment, the outer diameter of the liner joints may have sections that are not provided with the support layer. The non-layered sections may be provided with anchors such as Carbide or with elastomeric seal bands.

In another embodiment, the expandable liner may be expanded by placing a bridge plug at the bottom of the expanded liner and a retrievable packer at the top of the liner and then pumping fluid pressure inside of the mechanically expanded liner. Other exemplary seals at the ends include swellable packers and plugs.

In another embodiment, the expandable liner may have a lower minimum yield strength such as 25,000 psi. or between 20,000 psi and 65,000 psi. Because the liner is expanded mechanically and then hydraulically expanded, the material grade can be softer because in the "supported" condition, the outer casing provides substantially all of the pressure capacity. The casing above and below the expanded liner is the same casing behind the liner so whatever fracturing pressure is to be applied, the casing must be capable of resisting the fracturing pressure. One advantage of a softer liner material is a reduced expansion force, which makes installations simpler and typically less expensive. Another advantage is a softer liner material is more resistant to hydrogen sulfide ($H_2S$). $H_2S$ is well known to cause brittle cracking and failures in steel pipe and is present in most oil and gas wells before the well is abandoned. Expansion often slightly hardens a typical liner, thereby making it more susceptible to $H_2S$. Therefore, a softer, starting liner material may be more resistance to $H_2S$ after expansion.

In another embodiment, a method of completing a wellbore includes positioning an expandable tubular having a support layer disposed on an exterior of the expandable tubular inside a casing; mechanically expanding the tubular and the support layer, wherein a distance between an outer diameter of the support layer and an inner diameter of the casing is reduced sufficiently to prevent burst of the tubular; and hydraulically expanding the support layer into contact with the casing.

In another embodiment, a method of completing a wellbore includes positioning an expandable tubular having a support layer disposed on an exterior of the expandable tubular inside a casing; and mechanically expanding the tubular and the support layer, wherein the support layer is expanded into contact with an inner diameter of the casing and the support layer is compressed.

In another embodiment, an expandable liner includes an expandable tubular having a threaded connection; and a support layer comprising polyurea disposed around an exterior of the expandable tubular.

In one or more of the embodiments described herein, the support layer comprises an elastomer.

In one or more of the embodiments described herein, the elastomer comprises polyurea.

In one or more of the embodiments described herein, the support layer comprises a polyurea.

In one or more of the embodiments described herein, the distance is 0.08 inches or less.

In one or more of the embodiments described herein, a thickness of the support layer is between 0.02 inches and 0.3 inches.

In one or more of the embodiments described herein, the support layer has a compressibility between 0% and 85%.

In one or more of the embodiments described herein, the support layer is disposed on at least 15% of the exterior surface of the tubular.

In one or more of the embodiments described herein, the method includes perforating the tubular.

In one or more of the embodiments described herein, the tubular comprises a coiled tubing.

In one or more of the embodiments described herein, wherein after expanding the support layer into contact with the casing, the tubular has an internal pressure resistance between 5,000 psi and 25,000 psi.

In one or more of the embodiments described herein, wherein after expanding the support layer into contact with the casing, the tubular has an internal pressure resistance between 8,500 psi and 18,000 psi.

In one or more of the embodiments described herein, wherein after expanding the support layer into contact with the casing, the support layer is compressed between 0% and 85% of its original thickness.

In one or more of the embodiments described herein, wherein after expanding the support layer into contact with the casing, the support layer has anchoring force between 5 kips/ft. and 50 kips/ft. at 250° F.

In one or more of the embodiments described herein, wherein after expanding the support layer into contact with the casing, the support layer forms a pressure seal between the tubular and the casing.

In one or more of the embodiments described herein, wherein after expanding the support layer into contact with the casing, the support layer is sufficiently resistant to prevent formation of flow path by the fracturing fluid.

In one or more of the embodiments described herein, wherein expanding the support layer into contact with the casing comprises expanding the support layer using a hydraulic pressure that is greater than or equal to a yield strength of the tubular.

In one or more of the embodiments described herein, wherein the hydraulic pressure is between the yield strength of the tubular and a maximum tensile strength of the tubular.

In one or more of the embodiments described herein, the method includes selecting a size of an expansion tool to control the distance between the outer diameter of the support layer and the inner diameter of the casing.

In one or more of the embodiments described herein, the method includes providing an elastomeric seal at one end of the tubular and expanding the elastomeric seal against the casing.

In one or more of the embodiments described herein, wherein expanding the support layer into contact with the casing increases the collapse resistance of the casing.

In one or more of the embodiments described herein, wherein expanding the support layer into contact with the casing increases the tensile strength of the tubular.

In one or more of the embodiments described herein, wherein the support layer is disposed on a connection of the tubular.

In one or more of the embodiments described herein, wherein a thickness of the support layer is compressed between 30% and 80%.

In one or more of the embodiments described herein, the liner includes a sealing member disposed at each end of the tubular.

In one or more of the embodiments described herein, the support layer has a thickness between 0.02 inches and 0.3 inches.

In one or more of the embodiments described herein, the support layer has a compressibility between 0% and 85%.

In one or more of the embodiments described herein, the support layer is disposed on at least 15% of the exterior surface of the tubular.

In one or more of the embodiments described herein, wherein the expandable tubular has a minimum yield strength between 20,000 psi and 80,000 psi.

In one or more of the embodiments described herein, the support layer is effective at sealing fluid communication.

In one or more of the embodiments described herein, the tubular has an elongation property between at least 20% and 50%.

In one or more of the embodiments described herein, the support layer is temperature resistant between 40° F. and 1,000° F.

In one or more of the embodiments described herein, the support layer is sufficiently resistant to abrasion to protect the tubular from abrasive rubbing during run in.

In one or more of the embodiments described herein, the support layer is disposed on a connection of the tubular.

In one or more of the embodiments described herein, the expandable tubular comprises coiled tubing.

In one or more of the embodiments described herein, the support layer include a metal particle selected from the group consisting of balls or chips made of steel, Carbide, or other metals having sufficient strength to enhance toughness, anchoring capacity, resistance to fluid migration, resistance to cutting, and combinations thereof.

In one or more of the embodiments described herein, the support layer include a non-metal particle selected from the group consisting of silicate sand, ceramic chips, or other non-metals having sufficient strength to enhance toughness, anchoring capacity, resistance to fluid migration, resistance to cutting, and combinations thereof.

In one or more of the embodiments described herein, the support layer further comprises a swellable elastomer.

In one or more of the embodiments described herein, the support layer has may have variable thickness along a length of the expandable tubular.

In one or more of the embodiments described herein, the support layer is configured to prevent corrosion of the expandable tubular.

While the foregoing is directed to embodiments of the present invention, other and further embodiments of the invention may be devised without departing from the basic scope thereof, and the scope thereof is determined by the claims that follow.

The invention claimed is:

1. A method of completing a wellbore, comprising:

positioning an expandable tubular having a support layer disposed on an exterior of the expandable tubular inside a casing;

mechanically expanding the tubular and the support layer using an expansion tool in contact with the tubular, wherein after mechanical expansion, a distance between an outer diameter of the support layer and an inner diameter of the casing is 0.08 inches or less to prevent bursting of the tubular; and contacting pressurized fluid against the tubular to further expand the tubular directly by the pressurized fluid, thereby hydraulically expanding the support layer into contact with the casing.

2. The method of claim 1, wherein the support layer comprises an elastomer.

3. The method of claim 2, wherein the elastomer comprises polyurea.

4. The method of claim 1, wherein the support layer is disposed on a connection of the tubular.

5. The method of claim 1, further comprising perforating the tubular.

6. The method of claim 1, wherein the tubular comprises a coiled tubing.

7. The method of claim 1, wherein after expanding the support layer into contact with the casing, the tubular has an internal pressure resistance between 5,000 psi and 25,000 psi.

8. The method of claim 1, wherein expanding the support layer into contact with the casing increases the tensile strength of the tubular.

9. The method of claim 1, wherein after expanding the support layer into contact with the casing, the support layer has anchoring force between 5 kips/ft. and 50 kips/ft. at 250° F.

10. The method of claim 1, wherein after expanding the support layer into contact with the casing, the support layer forms a pressure seal between the tubular and the casing.

11. The method of claim 1, wherein the pressurized fluid is at a pressure that is between the yield strength of the tubular and a maximum tensile strength of the tubular.

12. The method of claim 1, further comprising selecting a size of an expansion tool to control the distance between the outer diameter of the support layer and the inner diameter of the casing.

13. The method of claim 1, wherein expanding the support layer into contact with the casing increases the collapse resistance of the casing.

14. The method of claim 1, wherein a thickness of the support layer is compressed between 30% and 80% after expansion of the support layer into contact with the casing.

15. The method of claim 1, wherein the distance is between 0.002 inches and 0.04 inches to the side.

16. The method of claim 1, wherein the support layer has a thickness between 0.05 inches and 0.15 inches.

17. The method of claim 1, wherein the support layer is disposed on at least 50% of the exterior surface of the tubular.

18. The method of claim 1, further comprising expanding an anchor disposed at a lower portion of the tubular into contact with the casing.

* * * * *